US010347237B2

(12) United States Patent
Tachibana et al.

(10) Patent No.: US 10,347,237 B2
(45) Date of Patent: Jul. 9, 2019

(54) SPEECH SYNTHESIS DICTIONARY CREATION DEVICE, SPEECH SYNTHESIZER, SPEECH SYNTHESIS DICTIONARY CREATION METHOD, AND COMPUTER PROGRAM PRODUCT

(71) Applicant: KABUSHIKI KAISHA TOSHIBA, Minato-ku, Tokyo (JP)

(72) Inventors: Kentaro Tachibana, Kawasaki Kanagawa (JP); Masatsune Tamura, Kawasaki Kanagawa (JP); Yamato Ohtani, Kawasaki Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/795,080

(22) Filed: Jul. 9, 2015

(65) Prior Publication Data

US 2016/0012035 A1 Jan. 14, 2016

(30) Foreign Application Priority Data

Jul. 14, 2014 (JP) ..... 2014-144378

(51) Int. Cl.
*G10L 13/00* (2006.01)

(52) U.S. Cl.
CPC ..... *G10L 13/00* (2013.01)

(58) Field of Classification Search
None
See application file for complete search history.

(56) References Cited

U.S. PATENT DOCUMENTS 8,244,534 B2 8/2012 Qian et al.
2004/0172250 A1* 9/2004 Liu ..... G10L 15/28 704/260

(Continued)

FOREIGN PATENT DOCUMENTS

JP 08-248994 9/1996
JP 5398909 11/2013

OTHER PUBLICATIONS

Yi-Jian Wu, et al. "State mapping based method for cross-lingual speaker adaptation in HMM-based speech synthesis", INTERSPEECH 2009, Brighton, UK, International Speech Communication Association, Sep. 2009, pp. 528-531.

(Continued)

*Primary Examiner* — Bharatkumar S Shah
(74) *Attorney, Agent, or Firm* — Amin, Turocy & Watson LLP

(57) ABSTRACT

According to an embodiment, a device includes a table creator, an estimator, and a dictionary creator. The table creator is configured to create a table based on similarity between distributions of nodes of speech synthesis dictionaries of a specific speaker in respective first and second languages. The estimator is configured to estimate a matrix to transform the speech synthesis dictionary of the specific speaker in the first language to a speech synthesis dictionary of a target speaker in the first language, based on speech and a recorded text of the target speaker in the first language and the speech synthesis dictionary of the specific speaker in the first language. The dictionary creator is configured to create a speech synthesis dictionary of the target speaker in the second language, based on the table, the matrix, and the speech synthesis dictionary of the specific speaker in the second language.

9 Claims, 6 Drawing Sheets

(56) References Cited

U.S. PATENT DOCUMENTS

| | | | | |
|---|---|---|---|---|
| 2009/0055162 | A1* | 2/2009 | Qian | G10L 13/06 704/8 |
| 2009/0106015 | A1* | 4/2009 | Li | G06F 17/2818 704/2 |
| 2010/0070262 | A1* | 3/2010 | Udupa | G06F 17/2735 704/7 |
| 2012/0278081 | A1 | 11/2012 | Chun et al. | |

OTHER PUBLICATIONS

Takashi Nose, et al. "A study on cross-lingual text-to-speech synthesis based on speaker adaptation using a shared decision tree", Acoustical Society of Japan, Sep. 2012, pp. 279-280.

* cited by examiner

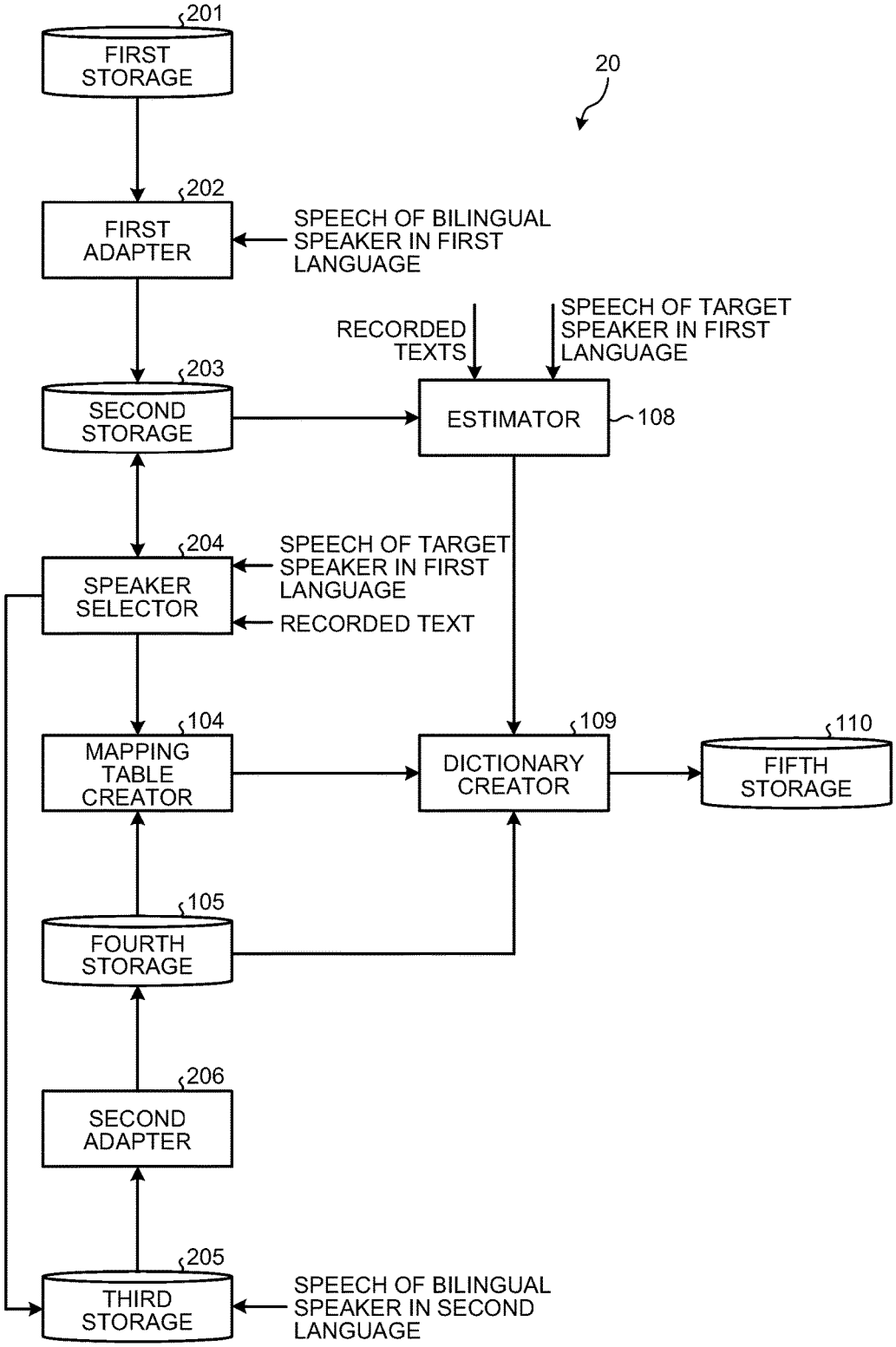
201
FIRST STORAGE
20
202
FIRST ADAPTER
SPEECH OF BILINGUAL SPEAKER IN FIRST LANGUAGE
RECORDED TEXTS
SPEECH OF TARGET SPEAKER IN FIRST LANGUAGE
203
SECOND STORAGE
ESTIMATOR
108
204
SPEAKER SELECTOR
SPEECH OF TARGET SPEAKER IN FIRST LANGUAGE
RECORDED TEXT
104
MAPPING TABLE CREATOR
109
DICTIONARY CREATOR
110
FIFTH STORAGE
105
FOURTH STORAGE
206
SECOND ADAPTER
205
THIRD STORAGE
SPEECH OF BILINGUAL SPEAKER IN SECOND LANGUAGE

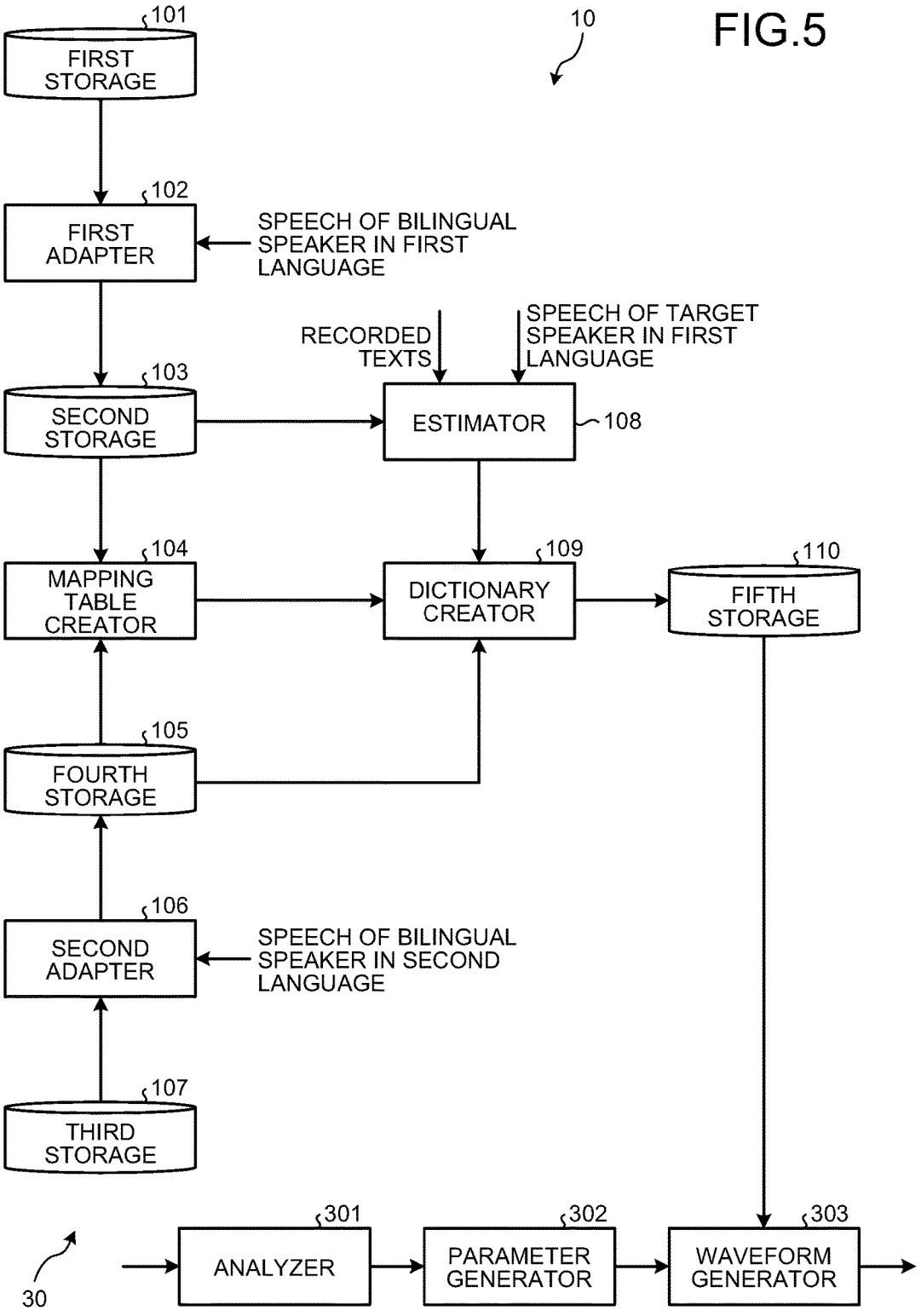
FIG.5
10
101
FIRST STORAGE
102
FIRST ADAPTER
SPEECH OF BILINGUAL SPEAKER IN FIRST LANGUAGE
RECORDED TEXTS
SPEECH OF TARGET SPEAKER IN FIRST LANGUAGE
103
SECOND STORAGE
ESTIMATOR
108
104
MAPPING TABLE CREATOR
109
DICTIONARY CREATOR
110
FIFTH STORAGE
105
FOURTH STORAGE
106
SECOND ADAPTER
SPEECH OF BILINGUAL SPEAKER IN SECOND LANGUAGE
107
THIRD STORAGE
30
301
ANALYZER
302
PARAMETER GENERATOR
303
WAVEFORM GENERATOR

SPEECH SYNTHESIS DICTIONARY CREATION DEVICE, SPEECH SYNTHESIZER, SPEECH SYNTHESIS DICTIONARY CREATION METHOD, AND COMPUTER PROGRAM PRODUCT

CROSS-REFERENCE TO RELATED APPLICATION

This application is based upon and claims the benefit of priority from Japanese Patent Application No. 2014-144378, filed on Jul. 14, 2014; the entire contents of which are incorporated herein by reference.

FIELD

Embodiments described herein relate generally to a speech synthesis dictionary creation device, a speech synthesizer, a speech synthesis dictionary creation method, and a computer program product.

BACKGROUND

Speech synthesis technologies for converting a certain text into a synthesized waveform are known. In order to reproduce the quality of voice of a certain user by using a speech synthesis technology, a speech synthesis dictionary needs to be created from recorded speech of the user. In recent years, research and development of speech synthesis technologies based on hidden Markov model (HMM) have been increasingly conducted, and the quality of the technologies is being improved. Furthermore, technologies for creating a speech synthesis dictionary of a certain speaker in a second language from speech of a certain speaker in a first language have been studied. A typical technique therefor is cross-lingual speaker adaptation.

In related art, however, large quantities of data need to be provided for conducting cross-lingual speaker adaptation. Furthermore, there is a disadvantage that high-quality bilingual data are required to improve the quality of synthetic speech.

BRIEF DESCRIPTION OF THE DRAWINGS

FIG. 4 is a block diagram illustrating a configuration of a speech synthesis dictionary creation device according to a second embodiment;

FIG. 5 is a block diagram illustrating a configuration of a speech synthesizer according to an embodiment.

DETAILED DESCRIPTION

Figure 1:
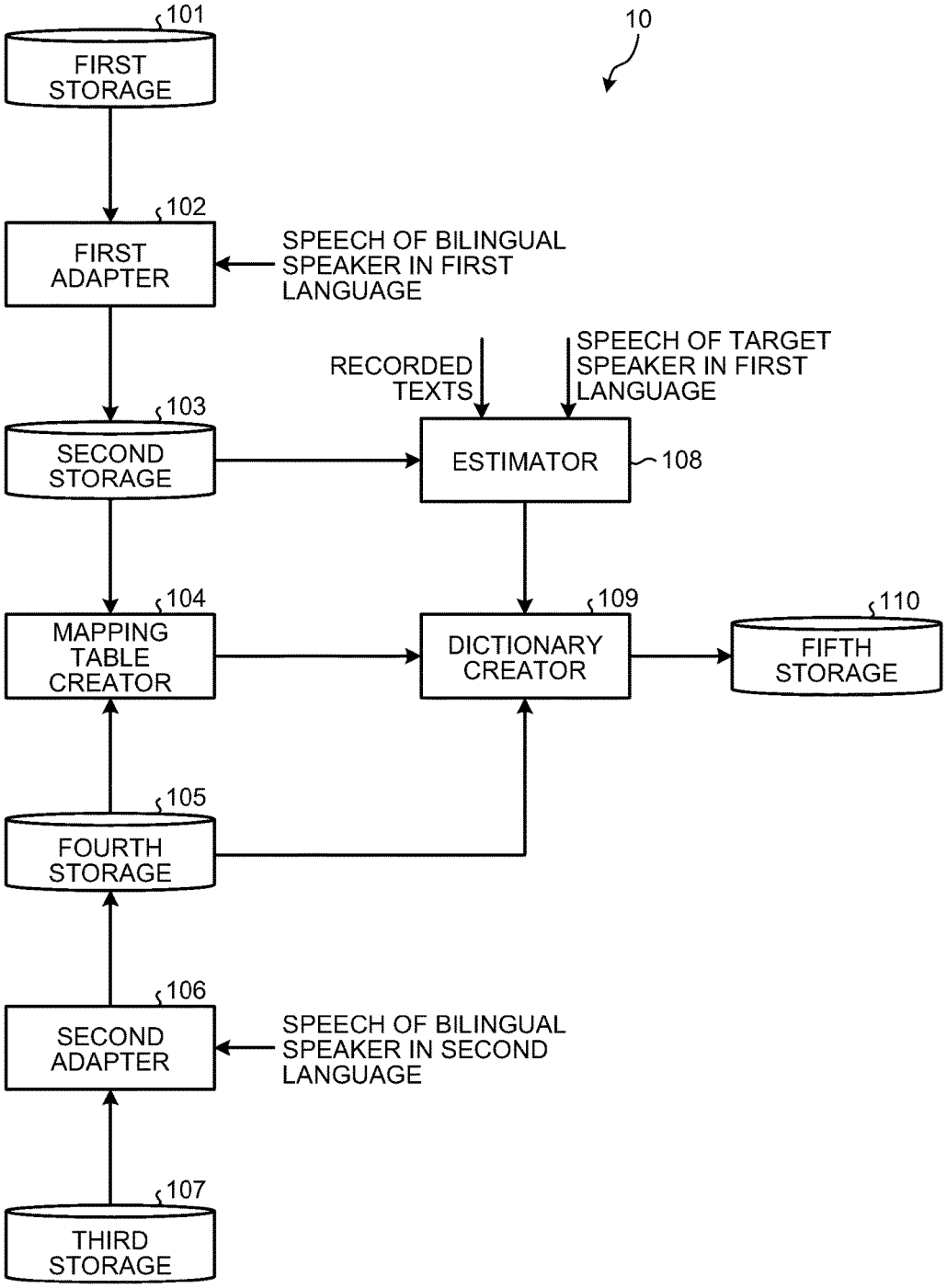
FIG. 1 is a block diagram illustrating a configuration of a speech synthesis dictionary creation device according to a first embodiment.

According to an embodiment, a speech synthesis dictionary creation device includes a mapping table creator, an estimator, and a dictionary creator. The mapping table creator is configured to create, based on similarity between distribution of nodes of a speech synthesis dictionary of a specific speaker in a first language and distribution of nodes of a speech synthesis dictionary of the specific speaker in a second language, a mapping table in which the distribution of nodes of the speech synthesis dictionary of the specific speaker in the first language is associated with the distribution of nodes of the speech synthesis dictionary of the specific speaker in the second language. The estimator is configured to estimate a transformation matrix to transform the speech synthesis dictionary of the specific speaker in the first language to a speech synthesis dictionary of a target speaker in the first language, based on speech and a recorded text of the target speaker in the first language and the speech synthesis dictionary of the specific speaker in the first language. The dictionary creator is configured to create a speech synthesis dictionary of the target speaker in the second language, based on the mapping table, the transformation matrix, and the speech synthesis dictionary of the specific speaker in the second language.

First, the background that led to the present invention will be described. The HMM described above if a source-filter speech synthesis system. This speech synthesis system receives as input a sound source a sound source signal (excitation source) generated from a pulse sound source representing sound source components produced by vocal cord vibration or a noise source representing a sound source produced by air turbulence or the like, and carries out filtering using parameters of a spectral envelope representing vocal tract characteristics or the like to generate a speech waveform.

Examples of filters using parameters of a spectral envelope include an all-pole filter, a lattice filter for PARCOR coefficients, an LSP synthesis filter, a logarithmic amplitude approximate filter, a mel all-pole filter, a mel logarithmic spectrum approximate filter, and a mel generalized logarithmic spectrum approximate filter.

Furthermore, one characteristic of the speech synthesis technologies based on the HMM is to be capable of diversely changing generated synthetic sounds. According to the speech synthesis technologies based on the HMM, the quality of voice and the tone of voice can also be easily changed in addition to the pitch (Fundamental frequency; $F_0$) and the Speech rate, for example.

Furthermore, the speech synthesis technologies based on the HMM can generate synthetic speech sounding like that of a certain speaker even from a small amount of speech by using a speaker adaptation technology. The speaker adaptation technology is a technology for performing to bring a certain speech synthesis dictionary to be adapted closer to a certain speaker so as to generate a speech synthesis dictionary reproducing the speaker individuality of a certain speaker.

The speech synthesis dictionary to be adapted desirably contains as few individual speaker's habits as possible. Thus, a speech synthesis dictionary that is independently of speakers is created by training a speech synthesis dictionary to be adapted by using speech data of multiple speakers. This speech synthesis dictionary is called "average voice".

The speech synthesis dictionaries constitute state clustering based on a decision tree with respect to features such as $F_0$, band aperiodicity, and spectrum. The spectrum expresses spectrum information of speech as a parameter. The band aperiodicity is information representing the intensity of a noise component in a predetermined frequency band in a spectrum of each frame as a ratio to the entire spectrum of the band. In addition, each leaf node of the decision tree holds a Gaussian distribution.

For performing speech synthesis, a distribution sequence is first created by following the decision tree according to context information obtained by converting an input text, and a speech parameter sequence is generated from the resulting distribution sequence. A speech waveform is then generated from the generated parameter sequence (band aperiodicity, $F_0$, spectrum).

Furthermore, technological development of multilingualization is also in progress as one of a diversity of speech synthesis. A typical technology thereof is the cross-lingual speaker adaptation technology mentioned above, which is a technology for converting a speech synthesis dictionary of a monolingual speaker into a speech synthesis dictionary of a particular language while maintaining the speaker individuality thereof. In a speech synthesis dictionary of a bilingual speaker, for example, a table for mapping a language of an input text to the closest node in an output language. When a text of the output language is input, nodes are followed from the output language side, and speech synthesis is conducted using distribution of nodes in the input language side.

Next, a speech synthesis dictionary creation device according to a first embodiment will be described. FIG. 1 is a block diagram illustrating a configuration of a speech synthesis dictionary creation device 10 according to the first embodiment. As illustrated in FIG. 1, the speech synthesis dictionary creation device 10 includes a first storage 101, a first adapter 102, a second storage 103, a mapping table creator 104, a fourth storage 105, a second adapter 106, a third storage 107, an estimator 108, a dictionary creator 109, and a fifth storage 110, for example, and creates a speech synthesis dictionary of a target speaker in a second language from target speaker speech in a first language. In the present embodiment, a target speaker refers to a speaker who can speak the first language but cannot speak the second language (a monolingual speaker, for example), and a specific speaker refers to a speaker who speaks the first language and the second language (a bilingual speaker, for example), for example.

The first storage 101, the second storage 103, the third storage 107, the fourth storage 105, and the fifth storage 110 are constituted by a single or multiple hard disk drives (HDDs) or the like, for example. The first adapter 102, the mapping table creator 104, the second adapter 106, the estimator 108, and the dictionary creator 109 may be either hardware circuits or software executed by a CPU, which is not illustrated.

The first storage 101 stores a speech synthesis dictionary of average voice in the first language. The first adapter 102 conducts speaker adaptation by using input speech (bilingual speaker speech in the first language, for example) and the speech synthesis dictionary of the average voice in the first language stored in the first storage 101 to generate a speech synthesis dictionary of the bilingual speaker (specific speaker) in the first language. The second storage 103 stores the speech synthesis dictionary of the bilingual speaker (specific speaker) in the first language generated as a result of the speaker adaptation conducted by the first adapter 102.

The third storage 107 stores a speech synthesis dictionary of average voice in the second language. The second adapter 106 conducts speaker adaptation by using input speech (bilingual speaker speech in the second language, for example) and the speech synthesis dictionary of the average voice in the second language stored by the third storage 107 to generate a speech synthesis dictionary of the bilingual speaker (specific speaker) in the second language. The fourth storage 105 stores the speech synthesis dictionary of the bilingual speaker (specific speaker) in the second language generated as a result of the speaker adaptation conducted by the second adapter 106.

The mapping table creator 104 creates a mapping table by using the speech synthesis dictionary of the bilingual speaker (specific speaker) in the first language stored in the second storage 103 and the speech synthesis dictionary of the bilingual speaker (specific speaker) in the second language stored in the fourth storage 105. More specifically, the mapping table creator 104 creates a mapping table associating distribution of nodes of the speech synthesis dictionary of the specific speaker in the second language with distribution of nodes of the speech synthesis dictionary of the specific speaker in the first language on the basis of the similarity between the nodes of the respective speech synthesis dictionaries of the specific speaker in the first language and in the second language.

The estimator 108 uses speech of the target speaker in the first language that is input and a recorded text thereof to extract acoustic features and contexts from the speech and the text, and estimates a transformation matrix for transforming the speech synthesis dictionary of the specific speaker in the first language to be speaker-adapted to the speech synthesis dictionary of the target speaker in the first language on the basis of the speech synthesis dictionary of the bilingual speaker in the first language stored in the second storage 103.

The dictionary creator 109 creates a speech synthesis dictionary of the target speaker in the second language by using the transformation matrix estimated by the estimator 108, the mapping table creator 104 created by the mapping table, and the speech synthesis dictionary of the bilingual speaker in the second language stored in the fourth storage 105. The dictionary creator 109 may be configured to use the speech synthesis dictionary of the bilingual speaker in the first language stored in the second storage 103.

The fifth storage 110 stores the speech synthesis dictionary of the target speaker in the second language created by the dictionary creator 109.

Next, detailed operation of the respective components included in the speech synthesis dictionary creation device 10 will be described. The speech synthesis dictionaries of the average voice in the respective languages stored in the first storage 101 and the third storage 107 are speech synthesis dictionaries to adapt for speaker adaptation and are generated from speech data of multiple speakers by using speaker adaptation training.

The first adapter 102 extracts acoustic features and the context from input speech data in the first language (bilingual speaker speech in the first language). The second adapter 106 extracts acoustic features and the context from input speech data in the second language (bilingual speaker speech in the second language).

Note that the speaker of the speeches input to the first adapter 102 and to the second adapter 106 is the same bilingual speaker who speaks the first language and the second language. Examples of the acoustic features include $F_0$, a spectrum, a phoneme duration, and a band aperiodicity sequence. The spectrum expresses spectrum information of speech as a parameter as described above. The context represents language attribute information in units of phonemes. The units of phonemes may be monophone, triphone, and quinphone. Examples of the attribute information include {preceding, present, succeeding} phonemes, the syllable position of the present phoneme in a word, {preceding, present, succeeding} parts of speech, the numbers of syllables in {preceding, present, succeeding} words, the number of syllables from an accented syllable, positions of words in a sentence, the presence or absence of preceding or succeeding poses, the numbers of syllables in {preceding, present, succeeding} breath groups, the position of the present breath group, and the number of syllables in a sentence. Hereinafter, these pieces of attribute information will be referred to as contexts.

Subsequently, the first adapter 102 and the second adapter 106 conduct speaker adaptation training from the extracted acoustic features and contexts on the basis of a maximum likelihood linear regression (MLLR) and a maximum a posteriori (MAP). The MLLR that is most frequently used will be described as an example.

The MLLR is a method for adaptation by applying linear transformation to an average vector of a Gaussian distribution or a covariance matrix. In the MLLR, a linear parameter is derived by an EM algorithm according to most likelihood criteria. A Q function of the EM algorithm is expressed as the following Equation (1).

$$Q(M, \hat{M}) = K - \frac{1}{2}\sum_{m=1}^{M}\sum_{\tau=1}^{T}\gamma_m\left[K^{(m)} + \log(|\hat{\Sigma}^{(m)}|) + (O(\tau) - \hat{\mu}^{(m)})^T\hat{\Sigma}^{(m)-1}(O(\tau) - \hat{\mu}^{(m)})\right] \quad (1)$$

$\hat{\mu}^{(m)}$ and $\hat{\Sigma}^{(m)}$ represent an average and a variance obtained by applying a transformation matrix to a component m.

In the expression, the superscript (m) represents a component of a model parameter. M represents the total number of model parameters relating to the transformation. K represents a constant relating to a transition probability. $K^{(m)}$ represents a normalization constant relating to a component m of the Gaussian distribution. Furthermore, in the following Equation (2), $q_m(\tau)$ represents a component of the Gaussian distribution at time τ. $O_T$ represents an observation vector.

$$\gamma_m(\tau)=p(q_m(\tau)|M, O_T) \quad (2)$$

Linear transformation is expressed as in the following Equations (3) to (5). Here, μ represents an average vector, A represents a matrix, b represents a vector, and W represents a transformation matrix. The estimator 108 estimates the transformation matrix W.

$$\hat{\mu}=A\mu+b=W\xi \quad (3)$$

ξ represents an average vector.

$$\xi=[1\mu^T]^T \quad (4)$$

$$W=[b^T A^T] \quad (5)$$

Since the effect of speaker adaptation using a covariance matrix is smaller than that using an average vector, speaker adaptation using an average vector is usually conducted. Transformation of an average is expressed by the following Equation (6). Note that kron( ) represents a Kronecker product of the expression enclosed by ( ), and vec( ) represents transformation into a vector with a matrix arranged in units of rows.

$$vec(Z) = \left(\sum_{m=1}^{M} kron(V^{(m)}, D^{(m)})\right)vec(W) \quad (6)$$

In addition, $V^{(m)}$, Z, and D are expressed by the following Equations (7) to (9), respectively.

$$V^{(m)} = \sum_{\tau=1}^{T}\gamma_m(\tau)\sum^{(m)-1} \quad (7)$$

$$Z = \sum_{m=1}^{M}\sum_{\tau=1}^{T}\gamma_m(\tau)\sum^{(m)-1} O(\tau)\xi^{(m)T} \quad (8)$$

$$D^{(m)} = \xi^{(m)}\xi^{(m)T} \quad (9)$$

An inverse matrix of $W_i$ is represented by the following Equations (10) and (11).

$$\hat{W}_i^T = G^{(i)-1}z_i^T \quad (10)$$

$$G^{(i)} = \sum_{m=1}^{M}\frac{1}{\sigma_i^{(m)2}}\xi^{(m)}\xi^{(m)T}\sum_{\tau=1}^{T}\gamma_m(\tau) \quad (11)$$

Furthermore, partial differentiation of Equation (1) with respect to $w_{ij}$ results in the following Equation (12). Thus, $w_{ij}$ is expressed by the following Equation (13).

$$\frac{\partial Q(M, \hat{M})}{\partial w_{ij}} = \sum_{m=1}^{M}\sum_{\tau=1}^{T}\gamma_m(\tau)\frac{1}{\sigma_i^{(m)2}}(o_i(\tau) - w_i\xi^{(m)})\xi_j^{(m)\tau} \quad (12)$$

$$w_{ij} = \frac{z_{ij} - \sum_{k\neq j} w_{ik}g_{ik}^{(i)}}{g_{ij}^{(i)}} \quad (13)$$

The second storage 103 stores the speaker-adapted speech synthesis dictionary in the first language generated by the first adapter 102. The fourth storage 105 stores the speaker-adapted speech synthesis dictionary in the second language generated by the second adapter 106.

The mapping table creator 104 measures similarity between the distributions of child nodes of the speaker-adapted speech synthesis dictionary in the first language and the speaker-adapted speech synthesis dictionary in the second language, and converts the association between distributions determined to be the closest into a mapping table (conversion to a table). Note that the similarity is measured using Kullback-Leibler divergence (KLD), a density ratio, or an L2 norm, for example. The mapping table creator 104 uses the KLD as expressed by the following Expressions (14) to (16), for example.

$$D_{KL}(\Omega_j^g, \Omega_k^s) << \frac{D_{KL}(G_k^s \,||\, G_j^g)}{1 - a_k^s} + \frac{D_{KL}(G_j^g \,||\, G_k^s)}{1 - a_j^g} + \frac{(a_k^s - a_j^g)\log\left(\frac{a_k^s}{a_j^g}\right)}{(1 - a_k^s)(1 - a_j^g)} \quad (14)$$

$G_j^g$: Gaussian distribution $G_k^s$: Gaussian distribution $\Omega_k^s$: state of original language at index k $\Omega_j^g$: state of target language at index j $$D_{KL}(G_k^s \mid\mid G_j^g) = \frac{1}{2}\ln\left(\frac{|\sum_j^g|}{|\sum_k^s|}\right) - \frac{D}{2} + \frac{1}{2}tr\left(\sum_j^{g-1}\sum_k^s\right) + \frac{1}{2}(\mu_j^g - \mu_k^s)^T\sum_j^{g-1}(\mu_j^g - \mu_k^2) \quad (15)$$

$\mu_k^s$: average of original language at index k
$\Sigma_k^s$: variance of child node of original language at index k $$D_{KL}(\Omega_j^g, \Omega_k^s) \approx D_{KL}(G_k^s \| G_j^g) + D_{KL}(G_k^s \| G_j^g) \quad (16)$$

Note that k represents an index of a child node, s represents an original language, and t represents a target language. Furthermore, the decision tree of the speech synthesis dictionary at the speech synthesis dictionary creation device 10 is trained by context clustering. Thus, it is expected to further reduce distortion caused by mapping by selecting the most representative phoneme in each child node of the first language from the contexts of the phonemes, and selecting distributions from only distributions having a representative phonemes identical thereto or having representative phonemes of the same type in the second language by using the International Phonetic Alphabet (IPA). The same type mentioned herein refers to agreement in the phoneme type such as vowel/consonant, voiced/unvoiced sound, or plosive/nasal/trill sound.

The estimator 108 estimates a transformation matrix for speaker adaptation from the bilingual speaker (specific speaker) to the target speaker in the first language on the basis of the speech and the recorded text of the target speaker in the first language. An algorithm such as the MLLR, the MAP, or the constrained MLLR (CMLLR) is used for speaker adaptation.

The dictionary creator 109 creates the speech synthesis dictionary of the target speaker in the second language by using the mapping table indicating the state of the speaker-adapted dictionary of the second language in which the KLD is the smallest as expressed by the following Equation (17) and applying the transformation matrix estimated by the estimator 108 to the bilingual speaker-adapted dictionary of the second language.

$$f(j) = \underset{k}{\operatorname{argmin}} D_{KL}(\Omega_j^g, \Omega_k^s) \quad (17)$$

Note that the transformation matrix $w_{ij}$ is calculated by Equation (13) above, but parameters on the right side of Equation (13) above are required therefor. These are dependent on Gaussian components μ and σ. When the dictionary creator 109 conducts transformation by using the mapping table, the transformation matrices applied to leaf nodes of the second language may vary largely, which may cause degradation in speech quality. Thus, the dictionary creator 109 may be configured to regenerate a transformation matrix for a higher-level node by using leaf nodes G and Z to be adapted.

The fifth storage 110 stores the speech synthesis dictionary of the target speaker in the second language created by the dictionary creator 109.

Figure 2:
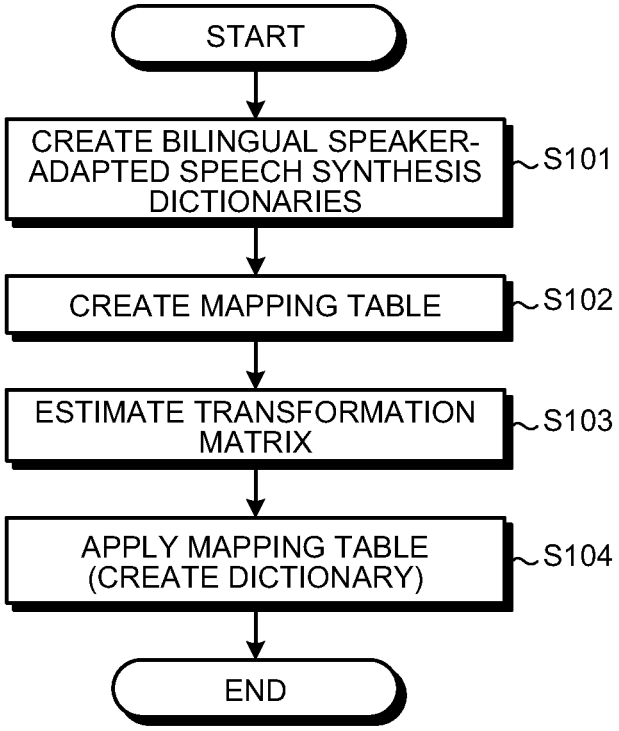
FIG. 2 is a flowchart illustrating processing performed by the speech synthesis dictionary creation device.

FIG. 2 is a flowchart illustrating processing performed by the speech synthesis dictionary creation device 10. As illustrated in FIG. 2, in the speech synthesis dictionary creation device 10, the first adapter 102 and the second adapter 106 first generate speech synthesis dictionaries adapted to the bilingual speaker in the first language and the second language, respectively (step S101).

Subsequently, the mapping table creator 104 performs mapping on the speaker-adapted dictionary of the first language at the leaf nodes of the second language by using the speech synthesis dictionaries of the bilingual speaker (speaker-adapted dictionaries) generated by the first adapter 102 and the second adapter 106, respectively (step S102).

The estimator 108 extracts contexts and acoustic features from the speech data and the recorded text of the target speaker in the first language, and estimates a transformation matrix for speaker adaptation to the speech synthesis dictionary of the target speaker in the first language on the basis of the speech synthesis dictionary of the bilingual speaker in the first language stored by the second storage 103 (step S103).

The dictionary creator 109 then creates the speech synthesis dictionary of the target language in the second language (dictionary creation) by applying the transformation matrix estimated for the first language and the mapping table to the leaf nodes of the bilingual speaker-adapted dictionary in the second language (step S104).

Figure 3B:
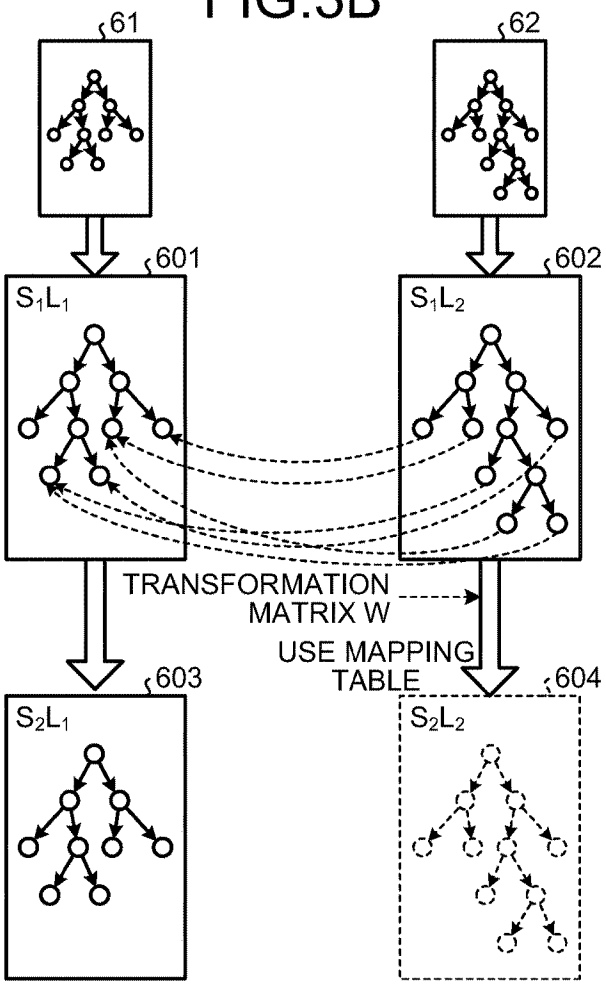
FIGS. 3A and 3B are conceptual diagrams illustrating operation of speech synthesis using a speech synthesis dictionary and operation of a comparative example in comparison with each other.
Figure 3A:
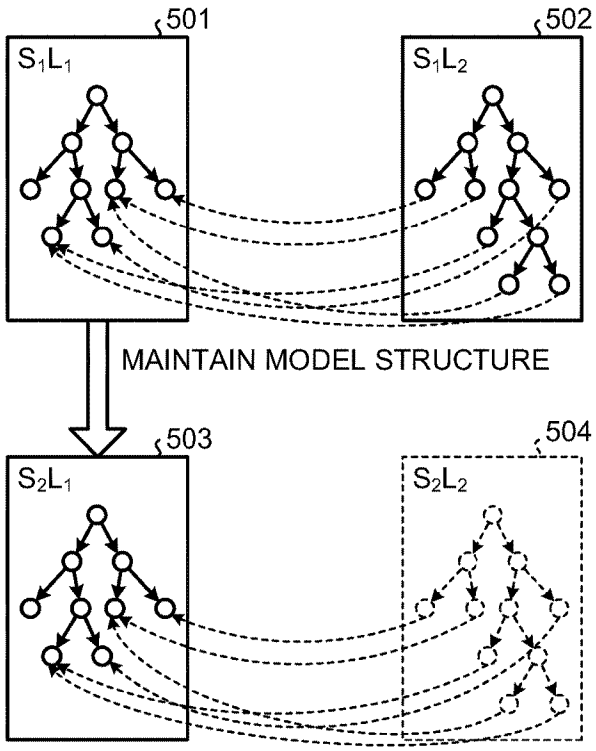

Subsequently, operation of speech synthesis using the speech synthesis dictionary creation device 10 will be described in comparison with a comparative example. FIGS. 3A and 3B are conceptual diagrams illustrating operation of speech synthesis using the speech synthesis dictionary creation device 10 and operation of the comparative example in comparison with each other. FIG. 3A illustrates operation of the comparative example. FIG. 3B illustrates operation using the speech synthesis dictionary creation device 10. In FIGS. 3A and 3B, S1 represents a bilingual speaker (multilingual speaker: specific speaker), S2 represents a monolingual speaker (target speaker), L1 represents a native language (first language), and L2 represents a target language (second language). In FIGS. 3A and 3B, the structures of the decision trees are the same.

As illustrated in FIG. 3A, in the comparative example, a mapping table of the state of a decision tree 502 of S1L2 and a decision tree 501 of S1L1. Furthermore, in the comparative example, a recorded text and speech containing completely the same context for a monolingual speaker are required. In addition, in the comparative example, synthetic sound is generated by following nodes of the decision tree 504 of the second language of a bilingual speaker to which nodes of the decision tree 503 of the first language of the same bilingual speaker are mapped, and using the distribution at the destination.

As illustrated in FIG. 3B, the speech synthesis dictionary creation device 10 generates a mapping table of the state by using a decision tree 601 of the speech synthesis dictionary obtained by conducting speaker adaptation of the multilingual speaker on a decision tree 61 of the speech synthesis dictionary of average voice in the first language and a decision tree 602 of the speech synthesis dictionary obtained by conducting speaker adaptation of the multilingual speaker on a decision tree 62 of the speech synthesis dictionary of average voice in the second language. Since speaker adaptation is used, the speech synthesis dictionary creation device 10 can generate a speech synthesis dictionary from any recorded text. Furthermore, the speech synthesis dictionary creation device 10 creates a decision tree 604 of the speech synthesis dictionary in the second language by reflecting a transformation matrix W for a decision tree 603 of S2L1 in the mapping table, and synthetic speech is generated from the transformed speech synthesis dictionary.

In this manner, since the speech synthesis dictionary creation device 10 creates the speech synthesis dictionary of the target speaker in the second language on the basis of the mapping table, the transformation matrix, and the speech synthesis dictionary of the specific speaker in the second language, the speech synthesis dictionary creation device 10 can suppress required speech data, and easily create the speech synthesis dictionary of the target speaker in the second language from the target speaker speech in the first language.

Next, a speech synthesis dictionary creation device according to a second embodiment will be described. FIG. 4 is a block diagram illustrating a configuration of the speech synthesis dictionary creation device 20 according to the second embodiment. As illustrated in FIG. 4, the speech synthesis dictionary creation device 20 includes a first storage 201, a first adapter 202, a second storage 203, a speaker selector 204, a mapping table creator 104, a fourth storage 105, a second adapter 206, a third storage 205, an estimator 108, a dictionary creator 109, and a fifth storage 110, for example. Note that the components of the speech synthesis dictionary creation device 20 illustrated in FIG. 4 that are substantially the same as those illustrated in the speech synthesis dictionary creation device 10 (FIG. 1) are designated by the same reference numerals.

The first storage 201, the second storage 203, the third storage 205, the fourth storage 105, and the fifth storage 110 are constituted by a single or multiple hard disk drives (HDDs) or the like, for example. The first adapter 202, the speaker selector 204, and the second adapter 206 may be either hardware circuits of software executed by a CPU, which is not illustrated.

The first storage 201 stores a speech synthesis dictionary of average voice in the first language. The first adapter 202 conducts speaker adaptation by using multiple input speeches (bilingual speaker speeches in the first language) and the speech synthesis dictionary of average voice in the first language stored by the first storage 201 to generate speech synthesis dictionaries of multiple bilingual speakers in the first language. The first storage 201 may be configured to store multiple bilingual speaker speeches in the first language.

The second storage 203 stores the speech synthesis dictionaries of the bilingual speakers in the first language each being generated by conducting speaker adaptation by the first adapter 202.

The speaker selector 204 uses speech and a recorded text of the target speaker in the first language that are input thereto to select a speech synthesis dictionary of a bilingual speaker in the first language that most resembles to the voice quality of the target speaker is selected from multiple speech synthesis dictionaries stored by the second storage 203. Thus, the speaker selector 204 selects one of the bilingual speakers.

The third storage 205 stores a speech synthesis dictionary of average voice in the second language and multiple bilingual speaker speeches in the second language, for example. The third storage 205 also outputs bilingual speaker speech in the second language of the bilingual speaker selected by the speaker selector 204 and the speech synthesis dictionary of average voice in the second language in response to an access from the second adapter 206.

The second adapter 206 conducts speaker adaptation by using the bilingual speaker speech in the second language input from the third storage 205 and the speech synthesis dictionary of average voice in the second language to generate a speech synthesis dictionary in the second language of the bilingual speaker selected by the speaker selector 204. The fourth storage 105 stores the speech synthesis dictionary of the bilingual speaker (specific speaker) in the second language generated by conducting speaker adaptation by the second adapter 206.

The mapping table creator 104 creates a mapping table by using the speech synthesis dictionary in the first language of the bilingual speaker (specific speaker) selected by the speaker selector 204 and the speech synthesis dictionary in the second language of the bilingual speaker (the same specific speaker) stored by the fourth storage 105 on the basis of the similarity between distributions of nodes of the two speech synthesis dictionaries.

The estimator 108 uses speech and a recorded text of the target speaker speech in the first language that are input thereto to extract acoustic features and contexts from the speech and the text, and estimates a transformation matrix for speaker adaptation to the speech synthesis dictionary of the target speaker in the first language on the basis of the speech synthesis dictionary of the bilingual speaker in the first language stored by the second storage 203. Note that the second storage 203 may be configured to output the speech synthesis dictionary of the bilingual speaker selected by the speaker selector 204 to the estimator 108.

Alternatively, in the speech synthesis dictionary creation device 20, the second adapter 206 and the third storage 205 may have configurations different from those illustrated in FIG. 4 as long as the speech synthesis dictionary creation device 20 is configured to conduct speaker adaptation by using the bilingual speaker speech in the second language of the bilingual speaker selected by the speaker selector 204 and the speech synthesis dictionary of average voice in the second language.

In the speech synthesis dictionary creation device 10 illustrated in FIG. 1, since transformation from a certain specific speaker is performed for adaptation from a speech synthesis dictionary adapted to the bilingual speaker to target speaker speech, the amount of transformation from the speech synthesis dictionary of average voice may be large, which may increase distortion. In contrast, in the speech synthesis dictionary creation device 20 illustrated in FIG. 4, since speech synthesis dictionaries adapted to some types of bilingual speakers are stored in advance, the distortion can be suppressed by appropriately selecting a speech synthesis dictionary from speech of the target speaker.

Examples of criteria on which the speaker selector 204 selects an appropriate speech synthesis dictionary include a root mean square error (RMSE) of a fundamental frequency ($F_0$) of synthetic speech obtained by synthesis from multiple texts by using a speech synthesis dictionary, a log spectral distance (LSD) of a mel-cepstrum, a RMSE of the duration of a phoneme, and a KLD of distribution of leaf nodes. The speaker selector 204 selects a speech synthesis dictionary with least transformation distortion on the basis of at least any one of these criteria, or the pitch of voice, the speed of speech, the phoneme duration, and the spectrum.

Next, a speech synthesizer 30 that creates a speech synthesis dictionary and synthesizes speech of a target speaker in a target language from a text of the target language will be described. FIG. 5 is a block diagram illustrating a configuration of a speech synthesizer 30 according to an embodiment. As illustrated in FIG. 5, the speech synthesizer 30 includes the speech synthesis dictionary creation device 10 illustrated in FIG. 1, an analyzer 301, a parameter generator 302, and a waveform generator 303. The speech synthesizer 30 may have a configuration including the speech synthesis dictionary creation device 20 instead of the speech synthesis dictionary creation device 10.

The analyzer 301 analyzes an input text and acquires context information. The analyzer 301 then outputs the context information to the parameter generator 302.

The parameter generator 302 follows a decision tree according to features on the basis of the input context information, acquires distributions from nodes, and generates distribution sequences. The parameter generator 302 then generates parameters from the generated distribution sequences.

The waveform generator 303 generates a speech waveform from the parameters generated by the parameter generator 302, and outputs the speech waveform. For example, the waveform generator 303 generates an excitation source signal by using parameter sequences of $F_0$ and band aperiodicity, and generates speech from the generated signal and a spectrum parameter sequence.

Figure 6:
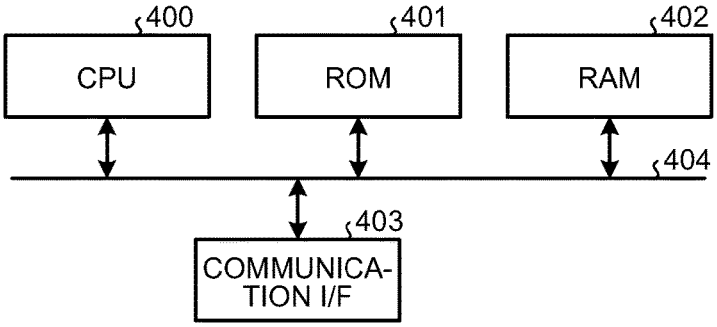
FIG. 6 is a diagram illustrating a hardware configuration of a speech synthesis dictionary creation device according to an embodiment.

Next, hardware configurations of the speech synthesis dictionary creation device 10, the speech synthesis dictionary creation device 20, and speech synthesizer 30 will be described with reference to FIG. 6. FIG. 6 is a diagram illustrating a hardware configuration of the speech synthesis dictionary creation device 10. The speech synthesis dictionary creation device 20 and the speech synthesizer 30 are also configured similarly to the speech synthesis dictionary creation device 10.

The speech synthesis dictionary creation device 10 includes a control device such as a central processing unit (CPU) 400, a storage device such as a read only memory (ROM) 401 and a random access memory (RAM) 402, a communication interface (I/F) 403 to connect to a network for communication, and a bus 404 connecting the components.

Programs (such as a speech synthesis dictionary creation program) to be executed by the speech synthesis dictionary creation device 10 are embedded in the ROM 401 or the like in advance and provided therefrom.

The programs to be executed by the speech synthesis dictionary creation device 10 may be recorded on a computer-readable recording medium such as a compact disk read only memory (CD-ROM), a compact disk recordable (CD-R) or a digital versatile disk (DVD) in a form of a file that can be installed or executed and provided as a computer program product.

Furthermore, the programs to be executed by the speech synthesis dictionary creation device 10 may be stored on a computer connected to a network such as the Internet, and provided by allowing the programs to be downloaded via the network. Alternatively, the programs to be executed by the speech synthesis dictionary creation device 10 may be provided or distributed via a network such as the Internet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech synthesis dictionary creation device comprising a processing circuitry coupled to a memory, the memory including a speech synthesis dictionary of average voice in a first language and a speech synthesis dictionary of the average voice in a second language, the processing circuitry being configured to:

estimate a first transformation matrix to transform the speech synthesis dictionary of the average voice in the first language to a speech synthesis dictionary of a bilingual speaker in the first language, based on speech of the bilingual speaker in the first language and the speech synthesis dictionary of the average voice in the first language, and generate the speech synthesis dictionary of the bilingual speaker in the first language by applying the first transformation matrix to the speech synthesis dictionary of the average voice in the first language;

estimate a second transformation matrix to transform the speech synthesis dictionary of the average voice in the second language to a speech synthesis dictionary of the bilingual speaker in the second language, based on speech of the bilingual speaker in the second language and the speech synthesis dictionary of the average voice in the second language, and generate the speech synthesis dictionary of the bilingual speaker in the second language by applying the second transformation matrix to the speech synthesis dictionary of the average voice in the second language;

create, based on similarity between distribution of nodes of the speech synthesis dictionary of the bilingual speaker in a first language and distribution of nodes of the speech synthesis dictionary of the speaker in the second language, a mapping table in which the distribution of nodes of the speech synthesis dictionary of the bilingual speaker in the first language is associated with the distribution of nodes of the speech synthesis dictionary of the bilingual speaker in the second language;

estimate a third transformation matrix to transform the speech synthesis dictionary of the bilingual speaker in the first language to a speech synthesis dictionary of a target speaker in the first language, based on speech and a recorded text of the target speaker in the first language and the speech synthesis dictionary of the bilingual speaker in the first language, similarly to the estimation of the first transformation matrix to transform the speech synthesis dictionary of the average voice in the first language to the speech synthesis dictionary of the bilingual speaker in the first language; and create a speech synthesis dictionary of the target speaker in the second language, by applying the third transformation matrix corresponding to a first node to a second node, the first node being one of nodes of the speech synthesis dictionary of the bilingual speaker in the first language, the second node being one of the nodes of the speech synthesis dictionary of the bilingual speaker in the second language and being associated with the first node, wherein the speech synthesis dictionary of the bilingual speaker in the first language, the speech synthesis dictionary of the bilingual speaker in the second language, and the speech synthesis dictionary of the target speaker in the second language are acoustic models that are constituted based on acoustic features, wherein the speech synthesis dictionary of the target speaker in the second language is data for an acoustic model used when speech of the target speaker in the second language is synthesized from the speech and the recorded text of the target speaker in the first language based on a voice quality of the target speaker, and an amount of data for an acoustic model of the target speaker is suppressed to be lower than that for an acoustic model of the bilingual speaker, and wherein the target speaker is a speaker who speaks the first language but cannot speak the second language, and the bilingual speaker is a speaker who speaks the first language and the second language; and based on the mapping table and the generated speech synthesis dictionaries, generate synthesized voice output.

2. The device according to claim 1, wherein the processing circuitry is configured to measure the similarity by using Kullback-Leibler divergence.

3. The device according to claim 1, wherein the processing circuitry is further configured to:

select the speech synthesis dictionary of the bilingual speaker in the first language from among speech synthesis dictionaries of multiple speakers in the first language, based on the speech and the recorded text of the target speaker in the first language, and create the mapping table by using the speech synthesis dictionary of the bilingual speaker in the first language selected and the speech synthesis dictionary of the bilingual speaker in the second language.

4. The device according to claim 3, wherein the processing circuitry is configured to select the speech synthesis dictionary of the bilingual speaker that most sounds like the speech of the target speaker at least in any of a pitch of voice, a speed of speech, a phoneme duration, and a spectrum.

5. The device according to claim 1, wherein the processing circuitry is configured to extract acoustic features and contexts from among the speech and the recorded text of the target speaker in the first language to estimate the transformation matrix.

6. The device according to claim 1, wherein the processing circuitry is configured to create the speech synthesis dictionary of the target speaker in the second language by applying the transformation matrix and the mapping table to leaf nodes of the speech synthesis dictionary of the bilingual speaker in the second language.

7. A speech synthesis dictionary creation method comprising:

estimating a first transformation matrix to transform a speech synthesis dictionary of average voice in a first language to a speech synthesis dictionary of a bilingual speaker in the first language, based on speech of the bilingual speaker in the first language and the speech synthesis dictionary of the average voice in the first language, and generating the speech synthesis dictionary of the bilingual speaker in the first language by applying the first transformation matrix to the speech synthesis dictionary of the average voice in the first language;

estimating a second transformation matrix to transform a speech synthesis dictionary of average voice in a second language to a speech synthesis dictionary of the bilingual speaker in the second language, based on speech of the bilingual speaker in the second language and the speech synthesis dictionary of the average voice in the second language, and generating the speech synthesis dictionary of the bilingual speaker in the second language by applying the second transformation matrix to the speech synthesis dictionary of the average voice in the second language;

creating, based on similarity between distribution of nodes of the speech synthesis dictionary of the bilingual speaker in the first language and distribution of nodes of the speech synthesis dictionary of the bilingual speaker in the second language, a mapping table in which the distribution of nodes of the speech synthesis dictionary of the bilingual speaker in the first language is associated with the distribution of nodes of the speech synthesis dictionary of the bilingual speaker in the second language;

estimating a third transformation matrix to transform the speech synthesis dictionary of the bilingual speaker in the first language to a speech synthesis dictionary of a target speaker in the first language, based on speech and a recorded text of the target speaker in the first language and the speech synthesis dictionary of the bilingual speaker in the first language, similarly to the estimating of the first transformation matrix to transform the speech synthesis dictionary of the average voice in the first language to the speech synthesis dictionary of the bilingual speaker in the first language;

creating a speech synthesis dictionary of the target speaker in the second language, by applying the third transformation matrix corresponding to a first node to a second node, the first node being one of nodes of the speech synthesis dictionary of the bilingual speaker in the first language, the second node being one of the nodes of the speech synthesis dictionary of the bilingual speaker in the second language and being associated with the first node, wherein the speech synthesis dictionary of the speaker in the first language, the speech synthesis dictionary of the bilingual speaker in the second language, and the speech synthesis dictionary of the target speaker in the second language are acoustic models that are constituted based on acoustic features, wherein the speech synthesis dictionary of the target speaker in the second language is data for an acoustic model used when speech of the target speaker in the second language is synthesized from the speech and the recorded text of the target speaker in the first language based on a voice quality of the target speaker, and an amount of data for an acoustic model of the target speaker is suppressed to be lower than that for an acoustic model of the bilingual speaker, and wherein the target speaker is a speaker who speaks the first language but cannot speak the second language, and the bilingual speaker is a speaker who speaks the first language and the second language; and based on the mapping table and the generated speech synthesis dictionaries, generating synthesized voice output.

8. A computer program product comprising a non-transitory computer-readable medium containing a program executed by a computer, the program causing the computer to execute:

estimating a first transformation matrix to transform a speech synthesis dictionary of average voice in a first language to a speech synthesis dictionary of a bilingual speaker in the first language, based on speech of the bilingual speaker in the first language and the speech synthesis dictionary of the average voice in the first language, and generating the speech synthesis dictionary of the bilingual speaker in the first language by applying the first transformation matrix to the speech synthesis dictionary of the average voice in the first language;

estimating a second transformation matrix to transform a speech synthesis dictionary of average voice in a second language to a speech synthesis dictionary of the bilingual speaker in the second language, based on speech of the bilingual speaker in the second language and the speech synthesis dictionary of the average voice in the second language, and generating the speech synthesis dictionary of the bilingual speaker in the second language by applying the second transformation matrix to the speech synthesis dictionary of the average voice in the second language;

creating, based on similarity between distribution of nodes of the speech synthesis dictionary of the bilingual speaker in the first language and distribution of nodes of the speech synthesis dictionary of the speaker in the second language, a mapping table in which the distribution of nodes of the speech synthesis dictionary of the bilingual speaker in the first language is associated with the distribution of nodes of the speech synthesis dictionary of the bilingual speaker in the second language;

estimating a third transformation matrix to transform the speech synthesis dictionary of the bilingual speaker in the first language to a speech synthesis dictionary of a target speaker in the first language, based on speech and a recorded text of the target speaker in the first language and the speech synthesis dictionary of the bilingual speaker in the first language, similarly to the estimation of the first transformation matrix to transform the speech synthesis dictionary of the average voice in the first language to the speech synthesis dictionary of the bilingual speaker in the first language;

creating a speech synthesis dictionary of the target speaker in the second language, by applying the third transformation matrix corresponding to a first node to a second node, the first node being one of nodes of the speech synthesis dictionary of the bilingual speaker in the first language, the second node being one of the nodes of the speech synthesis dictionary of the bilingual speaker in the second language and being associated with the first node, wherein the speech synthesis dictionary of the bilingual speaker in the first language, the speech synthesis dictionary of the bilingual speaker in the second language, and the speech synthesis dictionary of the target speaker in the second language are acoustic models that are constituted based on acoustic features, wherein the speech synthesis dictionary of the target speaker in the second language is data for an acoustic model used when speech of the target speaker in the second language is synthesized from the speech and the recorded text of the target speaker in the first language based on a voice quality of the target speaker, and an amount of data for an acoustic model of the target speaker is suppressed to be lower than that for an acoustic model of the bilingual speaker, and wherein the target speaker is a speaker who speaks the first language but cannot speak the second language, and the bilingual speaker is a speaker who speaks the first language and the second language; and based on the mapping table and the generated speech synthesis dictionaries, generating synthesized voice output.

9. A speech synthesizer comprising:

a speech synthesis dictionary creation device including first processing circuitry coupled to a memory, the first processing circuitry being configured to:

estimate a first transformation matrix to transform a speech synthesis dictionary of average voice in a first language to a speech synthesis dictionary of a bilingual speaker in the first language, based on speech of the bilingual speaker in the first language and the speech synthesis dictionary of the average voice in the first language, and generate the speech synthesis dictionary of the bilingual speaker in the first language by applying the first transformation matrix to the speech synthesis dictionary of the average voice in the first language;

estimate a second transformation matrix to transform a speech synthesis dictionary of the average voice in a second language to a speech synthesis dictionary of the bilingual speaker in the second language, based on speech of the bilingual speaker in the second language and the speech synthesis dictionary of the average voice in the second language, and generate the speech synthesis dictionary of the bilingual speaker in the second language by applying the second transformation matrix to the speech synthesis dictionary of the average voice in the second language;

create, based on similarity between distribution of nodes of the speech synthesis dictionary of the bilingual speaker in the first language and distribution of nodes of the speech synthesis dictionary of the bilingual speaker in the second language, a mapping table in which the distribution of nodes of the speech synthesis dictionary of the bilingual speaker in the first language is associated with the distribution of nodes of the speech synthesis dictionary of the bilingual speaker in the second language;

estimate a third transformation matrix to transform the speech synthesis dictionary of the bilingual speaker in the first language to a speech synthesis dictionary of a target speaker in the first language, based on speech and a recorded text of the target speaker in the first language and the speech synthesis dictionary of the bilingual speaker in the first language, similarly to estimation of the first transformation matrix to transform the speech synthesis dictionary of the average voice in the first language to the speech synthesis dictionary of the bilingual speaker in the first language; and create a speech synthesis dictionary of the target speaker in the second language, based on the mapping table, the third transformation matrix, and the speech synthesis dictionary of the bilingual speaker in the second language; and second processing circuitry being configured to generate a speech waveform by using the speech synthesis dictionary of the target speaker in the second language created by the speech synthesis dictionary creation device, wherein the speech synthesis dictionary of the target speaker in the second language is data for an acoustic model used when speech of the target speaker in the second language is synthesized from the speech and the recorded text of the target speaker in the first language based on a voice quality of the target speaker, and an amount of data for an acoustic model of the target speaker is suppressed to be lower than that for an acoustic model of the bilingual speaker.

* * * * *